US005706740A

United States Patent [19]

Keller, Jr.

[11] Patent Number: 5,706,740

[45] Date of Patent: Jan. 13, 1998

[54] TREE SHELF

[76] Inventor: Peter J. Keller, Jr., Rt. 1, Box 1270, Hayward, Wis. 54843-9736

[21] Appl. No.: 761,610

[22] Filed: Dec. 6, 1996

[51] Int. Cl.[6] ..... A47B 5/00

[52] U.S. Cl. ..... 108/152; 108/42; 108/108

[58] Field of Search ..... 108/152, 42, 102, 108/108; 182/187

[56] References Cited

U.S. PATENT DOCUMENTS

| | | | |
|---|---|---|---|
| 2,996,193 | 8/1961 | Olson | 108/152 X |
| 3,030,160 | 4/1962 | Tandy | 182/187 X |
| 3,031,245 | 4/1962 | Phillips | 108/152 X |
| 4,130,180 | 12/1978 | Ferguson et al. | 182/187 |
| 4,230,296 | 10/1980 | Staley . | |
| 4,600,081 | 7/1986 | Wade | 108/152 X |
| 5,156,096 | 10/1992 | Lamprey | 108/152 |
| 5,253,837 | 10/1993 | Loux | 108/152 X |
| 5,292,014 | 3/1994 | Lelong . | |
| 5,301,911 | 4/1994 | Beauchemin . | |
| 5,311,967 | 5/1994 | Kennedy | 182/187 X |
| 5,427,344 | 6/1995 | Beauchemin . | |
| 5,562,180 | 10/1996 | Herzog et al. | 108/152 X |

*Primary Examiner*—Jose V. Chen

*Attorney, Agent, or Firm*—Joseph H. McGlynn, Patent & Trademark Services, Inc.

[57] ABSTRACT

A vertically supported shelf surface having adjustable lower braces which may be adjusted horizontally to engage upright supports having different diameters, such as trees. Each brace has several openings to engage rails which slide there through. Two spaced vertical supports with holes are fixed to the braces and have holes through which a belt extending through them may be fastened around the upright support (e.g., a tree). The shelf's planar surface may be downwardly inclined towards the upright support tree and have a peripheral edge rim. Two functionally similar but with different designs may be used for the vertical section's braces.

5 Claims, 1 Drawing Sheet

TREE SHELF

BACKGROUND OF THE INVENTION

Outdoor hanging planters are used by many persons to decorate the environment around their homes. When doing so some type of vertical support is need to hang the planter from. This could be a vertical post with a horizontal extension, a tree branch or an extending horizontal bracket attached to a building structure. The present invention seeks to expand the homeowners choice of supports for planters and many other objects by providing for a tree supported shelf which can be adjusted to accommodate its fitting around a great variety of trees while not requiring the use of damaging fasteners to attach the shelf to the tree.

DESCRIPTION OF THE PRIOR ART

The prior art is replete with vertical supporting shelves. For example, in U.S. Pat. No. 4,230,296 to Staley et al. discloses (see FIG. 5) an outdoor platform and holding device for hunting implements and similar items which can be attached to a tree. Another support device is set forth in U.S. Pat. No. 5,292,014 to Lelong wherein horizontally disposed members are attached to a tensile cable which may be fastened by a belt around a tree. The Beauchemin U.S. Pat. No. 5,301,911 describes a tree supported belt having outer brackets from which articles may be suspended. And in the related U.S. Pat. No. 5,427,344 also to Beauchemin the belt supported brackets have both vertical cords and downwardly depending cords which support outwardly extending shelves. The present invention provides for a tree supported shelf whose supporting brackets are adjustable with respect to each other such that different diameter trees may be engaged as set forth in this specification.

SUMMARY OF THE INVENTION

The present invention relates to a horizontally disposed shelf which can be attached to an upright member, such as a tree, by an encircling belt. Lower shelf support brackets have vertical members which are supported by the belt and have openings for the belt which allow the distance between them to be adjusted to take into consideration various diameter trees. Located under the shelf is at least one lateral rail which extends through both bracket's upper horizontally disposed arms to accommodate the different diameter trees. An outer rim may extend around the horizontally shelf's surface, which surface can be slightly inclined downwardly towards the supporting upright member.

It is the primary object of the present invention to provide for an improved shelf which can be attached to a vertically disposed upright member such as a tree.

Another object is to provide for such a shelf wherein different diameter trees may be engaged by adjusting the distances between support brackets.

These and other objects and advantages of the present invention will become apparent to readers from a consideration of the ensuing description and the accompanying drawings.

DESCRIPTION OF THE PREFERRED EMBODIMENT

Figure 2:
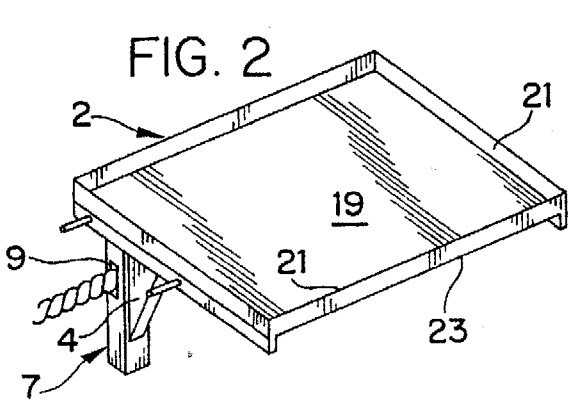
FIG. 2 is a top view of the FIG. 1 shelf.
Figure 1:
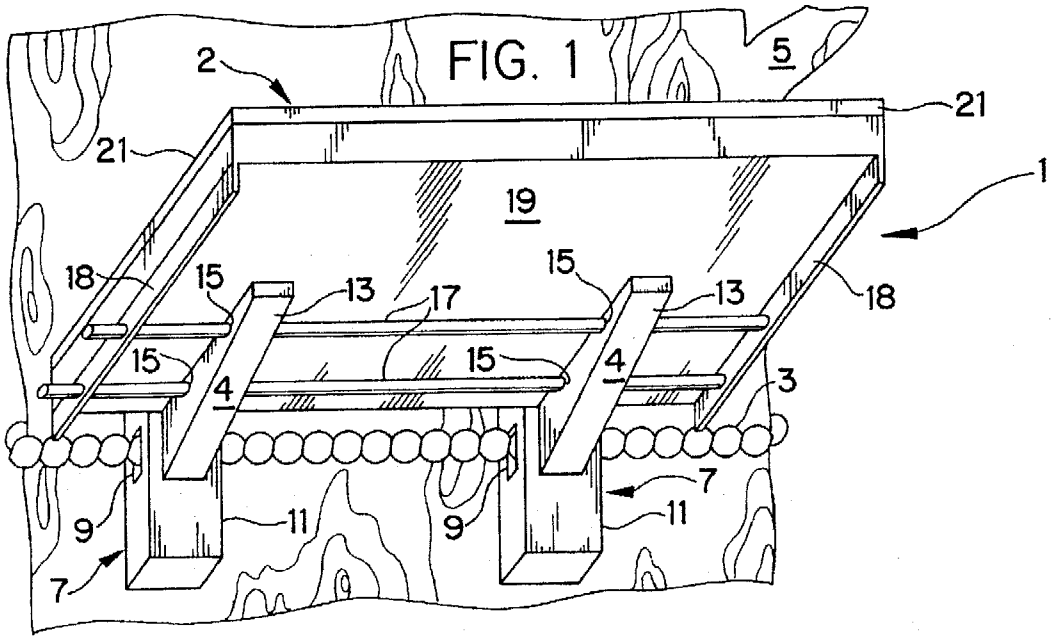
FIG. 1 is a front perspective view of the invention's preferred embodiment looking up from the ground.

FIG. 1 is a front perspective view of the invention's preferred shelf embodiment looking up from the ground. In this particular embodiment the shelf 1 has an adjustable stretchable belt fastener 3 which encircles an upright member such as the tree 5. A conventional buckle or hook and loop (Velcro™) fastener (not shown) is attached to the belt's free opened end and used to adjustably attached the belt around the encircled upright member. Two spaced lower brackets or braces 7 slidably receive the belt 3 through openings 9 located in their vertically disposed braces sections 11. Extending generally horizontally from these sections are two spaced brace members 13 one of which is fixed to each brace section 11. Four small holes 15 go through members 13 each of which slidably receives a portion of one of the two separate parallel spaced rails 17. These rails span the distance between two lower dependent side edges 18 attached to the underside of the planar rectangular shelf surface 19. This shelf surface is slidably supported by the two spaced members 13. The bottom side of the shelf surface 19 is shown in FIG. 1. The top side of surface 19 is shown in FIG. 2 and has an elevated peripheral or edge rim 21 which extends around its four sides to retain articles placed thereon from sliding off.

Figure 3:
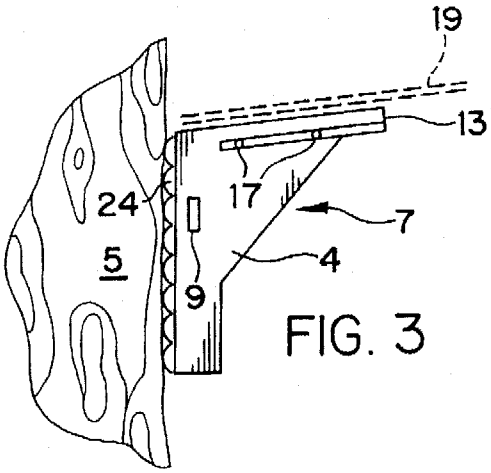
FIG. 3 shows a side view of one embodiment for the supporting bracket.

Articles or objects, especially heavy ones, placed on the top side of surface 19 would have a tendency to fall towards its front unsupported end away from the rear upright support when the belt 3 is tightened around the upright. To counter this forward leaning tendency, the surface 19 may have its free outer front end 23 slightly raised to provide a downwardly sloping surface towards the rear upright member. The side view of the surface 19 with its lower support braces 7 in FIG. 3 shows how this is accomplished by slightly sloping the brace's horizontally disposed extending arm 13. As shown in this side view figure, a non-skid backing 24 lines and is attached to the back of the braces 7 where they engage the support tree 5.

Figure 4:
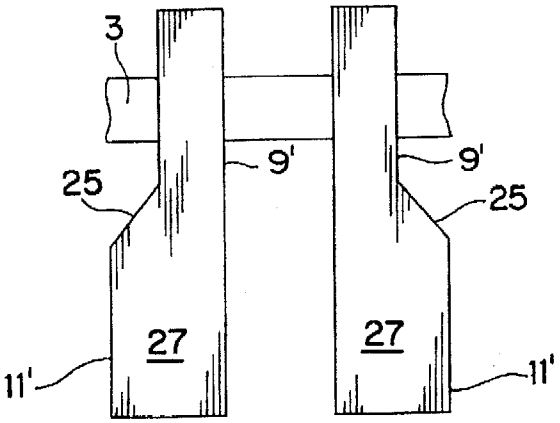
FIG. 4 is a front view of second embodiment for the shelf's support bracket.

The lower support vertical members 11 for the braces 7 can be shaped differently as in the FIG. 4 embodiment wherein similarly numbered features have been given the same number with a prime added. As shown, the brace opening 9' for the belt 3' extends through the vertical support brace section 11' In this embodiment, the lower portion of member 11' has a downwardly sloping outer side surface 25 which makes the member's lower section 27 considerably wider than its upper section 29. Thus, unlike the lower brace section 11 with the same thickness along its height as in the FIG. 1 embodiment, the FIG. 4 brace has a different width when viewed from the front looking towards the upright support. Functionally both brace embodiments perform the same to support the upper shelf and engage the upright member.

In order to adjust the width spacing between the two lower brackets or braces 7 one or both of them can be moved along their lateral rails 17 and belt 3 by pushing the brace(s) either towards or away from the other brace. This pushing action causes the braces to slide along rails 17 and the belt 3 by virtue of their engage with the brace openings. Since the rear side of the brace's lower portion 11 is what actually bears against the supporting vertical upright member (e.g., a tree) by adjusting the differences between the brace members 7 different diameter trees can be engaged within the limits provided by the two spaced rails 17.

A great variety of different articles or items can be placed on the top side of surface 19. This includes almost any article whose weight can be supported by the shelf and the upright member. Examples, include, but are not limited to, potted plants, yard ornaments, foods and cooking utensils, beverage with their holders, and electronic equipment such as radios, portable televisions and stereos.

One of the primary vertical upright members envisioned for supporting the invention is a tree. However, other vertical upright members could also be used such as outdoor posts, poles, brick columns, etc. as long as the belt 3 can encircle and be attached around them.

Although the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What 1 claim as my invention is:

1. An adjustable shelf supported on a vertical upright member comprising:

a generally horizontally disposed planar shelf surface;

two lower spaced support braces attached to said shelf, each of said braces having at least two lateral openings here through and a vertical upright engaging surface;

a shelf support member for encircling said vertical upright member and fastened thereto, said shelf support member slidable engaging one of said openings in each brace; and a rail member extending through another of said brace openings and slidably movable there along whereby the spacing between the support braces may be changed by sliding the braces along their engaged shelf support member and rail.

2. The invention as claimed in claim 1, wherein said shelf support member is a flexible belt member having an end fastener.

3. The invention as claimed in claim 2, wherein there are two separate parallel rails and two openings in each brace to slidably engages these openings.

4. The invention as claimed in claim 3, wherein said generally horizontally disposed planar shelf surface is slightly inclined downwardly towards said upright member and has a elevated rim around its edges.

5. The invention as claimed in claim 4, wherein said braces have wider lower sections than their top sections.

* * * * *